US005386994A

United States Patent [19]

Baranowski

[11] Patent Number: 5,386,994

[45] Date of Patent: Feb. 7, 1995

[54] BOARD GAME

[76] Inventor: Garry L. Baranowski, 3130 16th St., Bakersfield, Calif. 93301

[21] Appl. No.: 194,161

[22] Filed: Feb. 9, 1994

[51] Int. Cl.[6] ..... A63F 3/00

[52] U.S. Cl. ..... 273/249; 273/248

[58] Field of Search ..... 273/241, 243, 248, 249, 273/258

[56] References Cited

U.S. PATENT DOCUMENTS

| | | | |
|---|---|---|---|
| D. 123,508 | 11/1940 | Moore | 273/248 X |
| D. 155,766 | 11/1949 | Anderson et al. | 273/248 X |
| 1,323,872 | 12/1919 | Lajara | 273/248 |
| 1,362,218 | 12/1920 | Baloin | 273/249 |
| 3,148,886 | 9/1964 | Sharp | 273/248 X |
| 3,166,325 | 1/1965 | First | 273/248 X |
| 3,395,922 | 8/1968 | Garangiotis | 273/248 |
| 3,433,483 | 3/1969 | Ellis | 273/248 |
| 3,533,628 | 10/1970 | Fisher . | |
| 3,762,714 | 10/1973 | Wilson | 273/248 |
| 3,804,416 | 4/1974 | Jones et al. | 273/248 X |
| 4,504,061 | 3/1985 | Michel | 273/250 |
| 4,932,666 | 6/1990 | Corle | 273/249 |
| 5,102,144 | 4/1992 | Dickerman | 273/241 |

FOREIGN PATENT DOCUMENTS

| | | | |
|---|---|---|---|
| 190456 | 4/1937 | Switzerland | 273/248 |
| 2226767 | 7/1990 | United Kingdom | 273/248 |

*Primary Examiner*—William E. Stoll
*Attorney, Agent, or Firm*—Richard L. Miller

[57] ABSTRACT

A star maze game, comprising marbles, a die, and a game board. The game board has four sides, three levels, and a continuous hole path near the periphery of the game board. There is a center star in the center of the board. The game board has four identical player groupings on each of its four edges, each assigned to a different player. Each player grouping has a starting position and a home position, the object of the game being accomplished by a player who is the first to move each of the marbles around the continuous hole path, from the starting position to the home position, with the exception of one last marble, which is moved to the center star. The relative movement around the board is controlled by the rolling of the die.

12 Claims, 1 Drawing Sheet

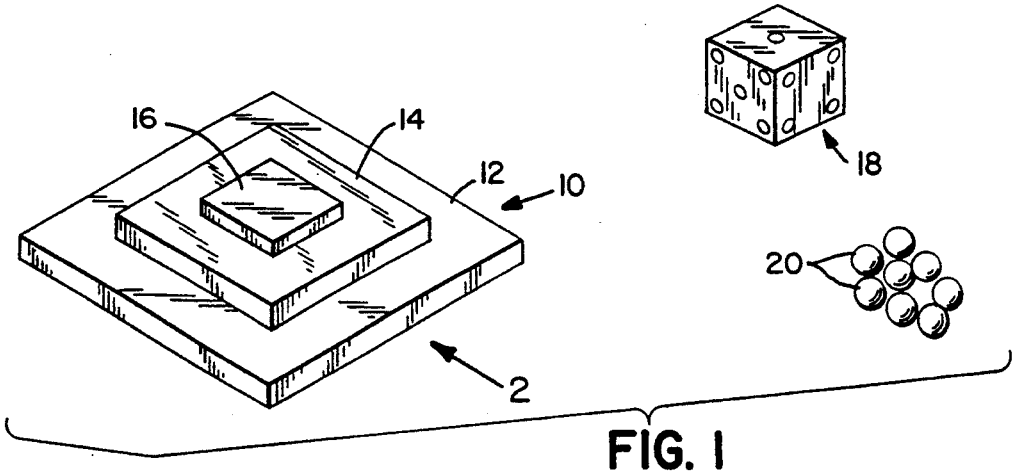
FIG. 1
FIG. 2
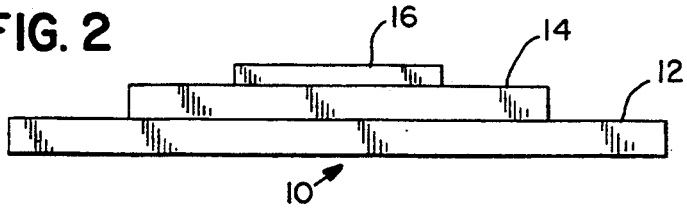
FIG. 4
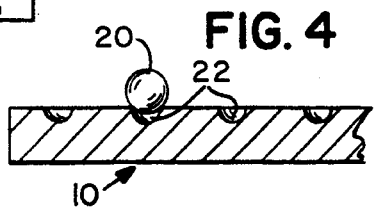
FIG. 3
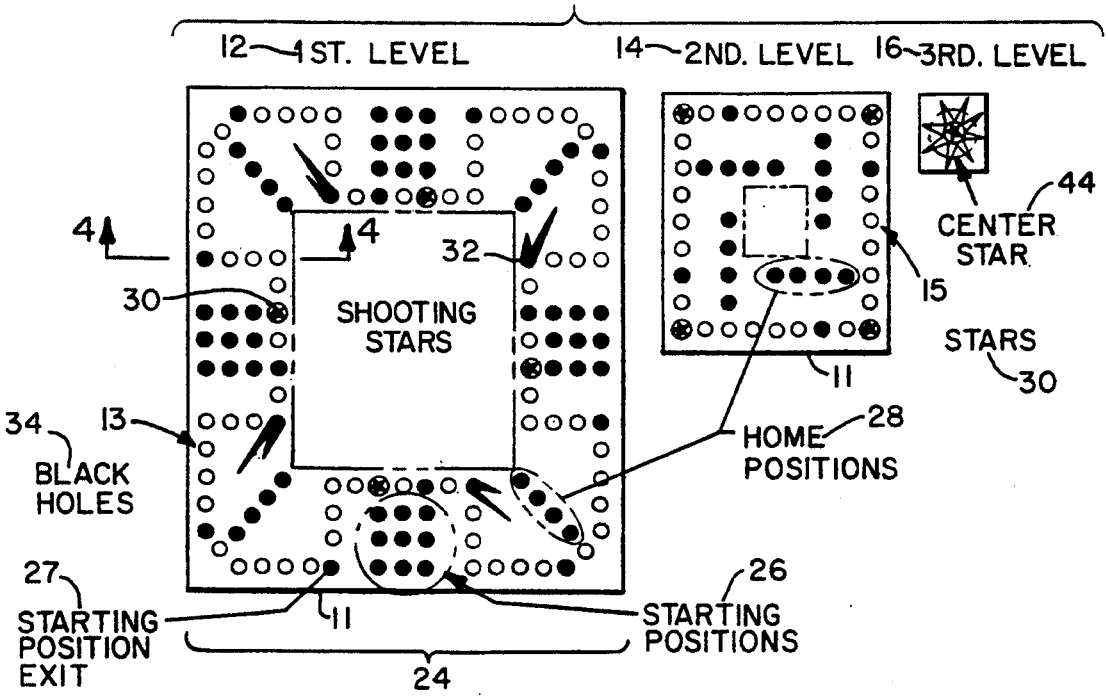

BOARD GAME

BACKGROUND OF THE INVENTION

The invention relates to a "star maze" board game.

U.S. Pat. No. 3,533,628 to Fisher, discloses a space travel board game apparatus, having several stages of play, from launch to re-entry.

U.S. Pat. No. 4,504,061 to Michel, discloses a space travel game apparatus, wherein travel stages from the earth to the moon are represented on the game board.

U.S. Pat. No. 4,932,666 to Corle, discloses a generally rectangular map game board an a method of playing a travel board game.

While these units may be suitable for the particular purpose to which they address, or to general use, they would not be as suitable for the purpose of the present invention as hereafter described.

SUMMARY OF THE INVENTION

It is an object of the invention to produce a board game that is entertaining to play.

It is a further object of the invention to produce a board game wherein the success of each player is determined in part by skill and strategy, and in part by chance.

It is another object of the invention to produce a board game that is economical to manufacture, so that it may be sold inexpensively.

It is further object of the invention to produce a board game that overcomes the shortcomings in the prior art.

It is a still further object of the invention to produce a board game having a multi-tiered playing field.

The invention is a "star maze" game, comprising marbles, a die, and a game board. The game board has four sides, three levels, and a continuous hole path near the periphery of the game board. There is a center star in the center of the board. The game board has four identical player groupings on each of its four edges, each assigned to a different player. Each player grouping has a starting position and a home position, the object of the game being accomplished by a player who is the first to move each of the marbles around the continuous hole path, from the starting position to the home position, with the exception of one last marble, which is moved to the center star. The relative movement around the board is controlled by the rolling of the die.

To the accomplishment of the above and related objects, this invention may be embodied in the form illustrated in the accompanying drawings, attention being called to the fact, however, that the drawings are illustrative only and that changes may be made in the specific construction illustrated and described, within the scope of the claims.

BRIEF DESCRIPTION OF THE DRAWINGS

In the drawings, like reference numerals depict like elements throughout the several views. The drawings are briefly described as follows:

FIG. 1 is a diagrammatic perspective view, illustrating a marshalling of the components of the instant invention, with all indicia omitted for clarity.

FIG. 2 is an edge view taken on arrow 2—2 of FIG. 1 of just the playing board per se.

FIG. 3 is an enlarged plan view illustrating typical game indicia required on the three levels.

FIG. 4 is an enlarged fragmentary sectional view taken on line 4—4 of FIG. 3 with a single marble illustrated resting on the playing board.

DETAILED DESCRIPTION OF THE PREFERRED EMBODIMENT

FIG. 1 illustrates the various components of the "star maze" board game. A game board 10, has a first level 12, a second level 14, and a third level 16. Each of the first level 12, the second level 14, and the third level 16, have substantially flat quadrilateral surfaces. Also included are a die 18, preferably having six sides, numbered one through six, consecutively, and marbles 20.

FIG. 2 an edge view, illustrating the game board 10. The second level 14 is mounted on top of the first level 12, the second level 14 defining a smaller surface than the first level 12, so that it fits entirely within the borders of the first level 12. The third level 16 is mounted on top of the second level 14, the third level 16 defining a smaller surface area than the second level 14, so that it fits entirely within the borders of the second level 14.

FIG. 4 is a cross sectional view, whereas the game board 10 has a plurality of holes 22, which are sized to cooperate with the marble 20, so that the marble 20 will remain stationary in the hole 22, but can be easily removed at the player's will.

The indicia of the game board, for playing the "star maze" game, is shown in FIG. 3. The game board 10 is arranged with four identical player groupings 24, each assigned to a different player, and each present on a side 11 of the quadrilateral game board 10. A first continuous hole path 13 extends around the first level near the periphery of the game board 10, and a second continuous hole path 15 extends around the second level. Each continuous hole path is substantially identical on each of the four sides 11 of the game board 10. Each player grouping 24 has a plurality of spaces, each having a hole 22, for holding a marble.

Each player grouping 24 has a starting position 26 located on the first level 12, comprising nine holes, each for holding a marble at the start of the game. The starting position 26 of each player grouping 24 has a starting position exit 27, disposed in the first continuous hole path 13, for allowing a marble to leave the starting position 26 and enter the first continuous hole path 13.

Each player grouping 24 also has home positions 28, distributed between the first level 12 and second level 14, disposed adjacent to the first continuous hole path 13 and second continuous hole path 15, respectively. The home position preferably comprises eight spaces: four on the first level 12 and four on the second level 14.

Also disposed in the first continuous hole path 13 and second continuous hole path 15 are stars 30, shooting stars 32, and black holes 34. The third level 16, has a center star 44.

The method of playing the "star maze" game is summarized as follows:

Each player starts with nine marbles 20, each located in a hole in the starting position 26. The object of the game is to be the first player to move eight of marbles to the player's home position 28, and the remaining marble to the center star 44.

Upon a proper roll of the die 18, preferably a "one" or "six", the player can move a marble out of the starting position 26. Once the marble 20 is out of the starting position 26, the player can move it clockwise around the game board along the first or second continuous hole path, according to the number indicated upon the roll on the die 18, with certain exceptions that follow.

When a player rolls a "four", they must move one of their marbles in the reverse direction (counter-clockwise). When a player rolls a "five" they have the option to split the roll, moving one of their marbles 3 holes, and another marble 2 holes. When a player rolls a "one" or a "six" they can roll again.

Players cannot at any time during the game, move one of their marbles past another of their own marbles. Further, if a player moves their marble upon the same hole occupied by another player's marble, the other player's marble is sent back to that player's starting position.

To enhance the speed with which the player moves their marble around the board, a player may employ special features embodied in the stars 30 and shooting stars 32.

When a player lands on a star 30, the player has the option to "jump" to the center star 44. On any subsequent roll, if the player rolls a "one" on the die, the player may exit to any star 30 on the board on any level, except a shooting star 32.

When a player lands on a shooting star 32, the player has the option to "shoot" to any star 30 on any level, except another shooting star 32 or the center star 44.

Once a player has moved a marble to the home position 28, that marble cannot be removed from the home position 28.

What is claimed is:

1. A board game, having a plurality of marbles, and a game board having four sides and a periphery, comprising:

a) at least two player groupings, each player grouping comprising:

i) a starting position, having more than one hole, where each hole holds a marble, and having a starting position exit; and ii) a home position, having approximately the same number of holes as in the starting position, for receiving the marbles from the starting position;

b) a continuous hole path for receiving the marbles extending around the game board and past all of the player groupings, the starting position and home position adjacent to the continuous hole path, and the starting position exit being disposed in the continuous hole path, the home position having holes for one less marble than the starting position has holes for, and further comprising a center star having a hole for holding a marble; and c) a die, for selecting the relative movement of the marbles around the continuous hole path of the game board, and for selectively allowing a marble to enter the continuous hole path from the starting position exit.

2. The apparatus as recited in claim 1, further comprising at least two shooting star positions, and at least two star positions, the shooting star positions and the star positions being disposed along the continuous path for allowing a player to move a marble around the board without following the continuous hole path.

3. The apparatus as recited in claim 2, further comprising a black hole, disposed along the continuous path, whereby a marble landing on a black hole will return to its starting position.

4. The apparatus as recited in claim 1, where the game board further comprises a first level and a second level, the starting positions being located on the first level, and the home positions distributed between the first and second levels; and a second continuous hole path on the second level.

5. The apparatus as recited in claim 3, further comprising a third level on which the center star is located.

6. The apparatus as recited in claim 1, where the home position has four spaces on the first level, and four spaces on the second level.

7. A board game, having a plurality of marbles, and a game board having four sides, a periphery and a first level and a second level, comprising:

a) at least two player groupings, each player grouping comprising:

i) a starting position on the first level, having more than one hole, where each hole holds a marble, and having a starting position exit; and ii) a home position, having approximately the same number of holes as in the starting position, for receiving the marbles from the starting position which home position holes are distributed between the first and the second levels;

b) a first and a second continuous hole path for receiving the marbles and extending around the game board on first and second levels, respectively, and past all of the player groupings, the starting position and home position adjacent to the continuous hole path, the starting position exit disposed in the continuous hole path; and c) a die, for selecting the relative movement of the marbles around the continuous hole path of the game board, and for selectively allowing a marble to enter the continuous hole path from the starting position exit.

8. The apparatus as recited in claim 7, further comprising at least two shooting star positions, and at least two star positions, the shooting star positions and the star positions being disposed along the continuous path for allowing a player to move a marble around the board without following the continuous hole path.

9. The apparatus as recited in claim 8, further comprising a black hole, disposed along the continuous path, whereby a marble landing on a black hole will return to its starting position.

10. The apparatus as recited in claim 7, where the home position has holes for one less marble than the starting position has holes for, and further comprising a center star having a hole for holding a marble.

11. The apparatus as recited in claim 10, where the home position has four spaces on the first level, and four spaces on the second level.

12. The apparatus as recited in claim 10, further comprising a third level on which the center star is located.

* * * * *